US008052709B2

(12) United States Patent
Blomdahl et al.

(10) Patent No.: US 8,052,709 B2
(45) Date of Patent: Nov. 8, 2011

(54) DEVICE FOR PIERCING AND POSITIONING OF BODY JEWELLERY HAVING A BENT BAR

(75) Inventors: Karl Blomdahl, Halmstad (SE); Lars Blomdahl, Haverdal (SE)

(73) Assignee: Blomdahl Medical Aktiebolag, Halmstad (SE)

( * ) Notice: Subject to any disclaimer, the term of this patent is extended or adjusted under 35 U.S.C. 154(b) by 486 days.

(21) Appl. No.: 12/094,935

(22) PCT Filed: Nov. 28, 2006

(86) PCT No.: PCT/SE2006/001350

§ 371 (c)(1),
(2), (4) Date: May 23, 2008

(87) PCT Pub. No.: WO2007/061365

PCT Pub. Date: May 31, 2007

(65) Prior Publication Data

US 2008/0287979 A1 Nov. 20, 2008

(30) Foreign Application Priority Data

Nov. 28, 2005 (SE) ..... 0502601-8

(51) Int. Cl.
*A61B 17/34* (2006.01)

(52) U.S. Cl. ..... 606/188

(58) Field of Classification Search ..... 606/117, 606/167, 181, 184–189; 227/67
See application file for complete search history.

(56) References Cited

U.S. PATENT DOCUMENTS

| | | | | |
|---|---|---|---|---|
| 4,020,848 | A * | 5/1977 | DiCicco | 606/188 |
| 5,004,470 | A * | 4/1991 | Mann | 606/188 |
| 5,004,471 | A | 4/1991 | Mann | |
| 5,423,858 | A | 6/1995 | Bolanos et al. | |
| 5,709,700 | A * | 1/1998 | Hirota | 606/188 |
| 5,792,170 | A | 8/1998 | Reil | |
| 6,065,661 | A * | 5/2000 | Kunreuther et al. | 227/67 |
| 6,468,288 | B1 | 10/2002 | Manning | |
| 2003/0153939 | A1 * | 8/2003 | Fritz et al. | 606/181 |
| 2006/0224173 | A1 * | 10/2006 | Reil et al. | 606/188 |

FOREIGN PATENT DOCUMENTS

| | | | |
|---|---|---|---|
| DE | 19816841 | A1 | 10/1999 |
| EP | 0559637 | | 9/1993 |
| GB | 765220 | A | 1/1957 |
| GB | 2310378 | A | 6/1997 |
| JP | 2005066004 | A | 3/2005 |

* cited by examiner

*Primary Examiner* — S. Thomas Hughes
*Assistant Examiner* — Katherine M Shi
(74) *Attorney, Agent, or Firm* — Volpe and Koenig, P.C.

(57) ABSTRACT

The invention concerns a device for piercing and positioning a piece of body jewelry with a bent bar in a skin portion. The device comprises an inner boundary surface which defines a cavity for holding a bent bar, the bar being movable out of the cavity to the surroundings through an opening defined by the boundary surface. The device also has a cam which is formed in the boundary surface and along which the bar is movable for such guiding of the bar that, during each incremental step of pressing-out, the bar has a cross-section exiting the opening, seen perpendicular to the longitudinal axis of the bar, which cross-section somewhere along a distance between the opening and an exit hole intended for piercing is perpendicular to an aiming line for piercing.

10 Claims, 6 Drawing Sheets

DEVICE FOR PIERCING AND POSITIONING OF BODY JEWELLERY HAVING A BENT BAR

FIELD OF THE INVENTION

The present invention relates to a device for piercing and positioning of body jewelry with a bent bar.

BACKGROUND ART

Piercing of body parts and skin portions thereof is frequently performed and occurs either manually or by some kind of instrument. The best known and most used instruments are especially adapted to piercing of ear lobes and can be divided into hand-operated and spring-operated instruments. An example of the former is given in U.S. Pat. No. 5,792,170 and an example of the latter is given in EP 0 559 637. However, the prior art instruments for piercing of ear lobes are, due to their construction, less suited or not at all suited for use on other body parts, in particular for pieces of body jewelry having a bent bar.

In all surgical operations, including piercing and positioning of pieces of jewelry in body parts, it is desirable to use products and methods which enable and facilitate aseptic handling. By asepsis is meant a process and technique which aim at preventing spreading of pathogenic microorganisms. Since piercing of body parts for insertion of body jewelry is often performed by non-medically trained staff, products and methods which allow a simple aseptic process are highly important.

A crucial aspect which differs piercing of ear lobes from piercing of certain other body parts, such as a navel, is the appearance of the bar of the piece of body jewelry which is to be preferred. When piercing an ear lobe, a completely straight bar is generally preferred. This means that the motion required for positioning the piece of ear jewelry is completely linear. The straight bar can be used since an ear lobe constitutes a well-defined flap-like area with a front side and a rear side. The straight bar can also advantageously be used as a piercing means.

When piercing other body parts where the hole is made by pinching an originally substantially plane skin portion, for example adjacent to a navel, a piece of body jewelry with a bent bar is preferred. The purely medical reason for this is that in piercing an originally substantially plane skin portion, a piece of body jewelry with a straight bar would cause more tension in the skin portion since the locking means and the decorative member of such a piece of jewelry abut against the plane skin and act to press out the bar from the plane skin surface. On a short view the risk of irritation and infection increases, while on a slightly longer view the risk increases that such a straight piece of jewelry is rejected by and migrates out of the body. Purely cosmetically, it is an advantage that in certain body parts, for instance a navel, a piece of body jewelry with a bent bar has a more attractive appearance.

The design of the bar of the piece of body jewelry affects the requirements placed on the piercing process since a piece of body jewelry with a straight bar can be inserted by completely linear motions, whereas a piece of body jewelry with a bent bar must be inserted by a non-linear motion. This motion can be resembled to a digging motion. The instruments that are known for piercing and positioning of jewelry, however, allow merely piercing and positioning of pieces of body jewelry with straight bars.

Piercing before and positioning of pieces of body jewelry with bent bars therefore take place to a great extent using purely manual aids by the skin in the area in which piercing is to take place, for example a navel, being disinfected and squeezed by a squeezing means in the form of a pair of tongs with loops in such a manner that the desired entry and exit holes are arranged opposite each other. Then piercing takes place by the operator holding a piercing means in the form of a cannula directly by his fingers and manually pressing the same through the skin portion through a marked desired entry hole and a marked desired exit hole. The cannula, which is straight, is pressed by a linear motion through the squeezed skin portion to form a straight passage therethrough. After that the bent bar is moved, by being gripped with the fingers, through the straight passage, which takes place by the operator making a digging motion with the bar. The digging motion is performed in order to reduce trauma to a minimum. By trauma is meant an action exerted on the skin portion and the associated tissue which can cause a remaining or temporary effect. In particular, a mechanical action in the form of pull, pressure or friction is intended. The digging motion means, in practice, that the operator presses the bent bar through the straight passage to form a passage having a curvature which as much as possible corresponds to the curvature of the bar, and a cross-section perpendicular to the longitudinal axis of the passage, which as much as possible corresponds to the corresponding cross-section of the bar. This takes place with minimum effect on the surrounding tissue, that is to cause as little trauma as possible. By definition, trauma cannot be avoided but only reduced.

It also happens that the cannula is mounted directly on the bar, whereby the bar is put in place in direct connection with the pressing of the cannula through the skin portion. To fix the piece of body jewelry in the skin, a locking means is mounted on the free end of the bar, which usually takes place manually.

The above described method requires the operator to have great experience and dexterity, and the risk of poor quality piercing is obvious.

Manual piercing is a bloody method, that is the handling is such that it is basically not possible to avoid blood being seen and exposed, which thus involves a serious risk of infection for the operator and discomfort to the person who is being pierced. The manual method also means that the operator is to touch with his fingers all components included in the piece of body jewelry, including the piercing means, and also comes into contact with the skin portion involved, which separately and together with the exposure of blood creates a serious risk of infection for both the patient and the operator. These risks of infection, of course, concern microorganisms which may cause seriously infected wounds, but the risks of infection also concern deadly blood virus, such as HIV and hepatitis.

There is also a need for a technique for piercing and positioning pieces of body jewelry with a bent bar, which proposes simple handling, reduces trauma and allows an aseptic process with respect to both the person being pierced and the operator.

OBJECTS OF THE PRESENT INVENTION

The object of the present invention is to provide a device for piercing and positioning a piece of body jewelry with a bent bar, which allows reduced trauma.

A further object of the present invention is to provide a device which allows an aseptic process for piercing and positioning a piece of body jewelry with a bent bar. The device should thus reduce the risk of infection and blood infection to a minimum, both for the person being pierced and for the operator.

Another object is to provide a device which is easy to use to provide high quality piercing.

SUMMARY OF THE INVENTION

To achieve the above objects and additional objects not stated, which will be evident from the following description, the present invention concerns a device for piercing and positioning a piece of body jewelry with a bent bar in a skin portion.

By bar is in the following meant a bar of a piece of body jewelry, which bar is adapted to be pressed through a skin portion in such a manner that a through hole is formed in the skin portion, and which bar comprises a piercing means to form said hole, that is a sharp means suitable for piercing. The piercing means can be integrated with the bar in the form of a sharp tip on its front end portion, which tip may be adapted to be removed or not removed after piercing. The piercing means can also be arranged to or arranged loosely in connection with the front end portion of the bar and consist of a cannula for example.

The expression skin portion is adapted to comprise also a mucous membrane.

According to a first aspect, the invention concerns a device for piercing and positioning a piece of body jewelry with a single-bent bar in a skin portion. The device is characterised in that it comprises an inner boundary surface which defines a cavity for holding a bent bar, the bar being movable out of the cavity to the surroundings through an opening defined by the boundary surface, and a cam means which is formed in the boundary surface and along which said bar is movable for such guiding of the bar that, during each incremental step of pressing out, the bar has a cross-section exiting the opening, seen perpendicular to the longitudinal axis of the bar, which cross-section, somewhere along a distance between said opening and an exit hole intended for piercing, is perpendicular to an aiming line for piercing.

By the bar being adapted to be accommodated in a cavity in the device, it is protected from the surroundings during handling of the device before and during piercing. This allows an aseptic process during piercing and positioning of a piece of body jewelry, that is the risk of infection and transfer of blood infection for both the person being pierced and for the operator is reduced.

With the inventive device and its cam means, the movement which is normally performed by the operator manually in the form of a linear motion in combination with a digging motion can be imitated, and with high repeatability. Both the linear and the digging motion are obtained by guiding the bar towards the cam means. By the cam means of the device, the bar can thus by passing through the skin portion, despite its curvature, be made to substantially follow the passage formed through the skin portion when a straight front portion of the bar is pressed through the skin portion to form a passage therethrough, which passage corresponds to a straight line.

The guiding is arranged so that during each incremental step of the pressing out, the bar has a cross-section exiting the opening, seen perpendicular to the longitudinal axis of the bar, which cross-section, somewhere along a distance between said opening and exit hole intended for piercing, is oriented perpendicular to the aiming line for piercing.

This applies whether the device during piercing is applied directly to the skin portion intended for piercing or to some kind of pinching and sighting means which is arranged to grip the skin portion during piercing.

By aiming line is meant an imaginary straight line which extends between a desired entry hole and a desired exit hole for piercing. By the cross-section of the bar with the inventive device being arranged perpendicular to this aiming line, it is ensured that the cross-section of the passage formed during piercing substantially corresponds to the cross-section of the bar, that is the cam means in cooperation with the curvature of the bar strives to create as narrow a passage as possible through the skin portion involved. This reduces trauma.

It will also be appreciated that the resulting cross-section along the entire length of the passage is dependent on, inter alia, the curvature of the bar, the length of the passage and that this length itself depends on the skin portion involved, the type of tissue and the stability in the same and also how firmly the skin portion is gripped and, thus, compressed during the piercing operation.

By the cam means being formed in the device, the digging motion of the bar is obtained with high repeatability, which requires less operator experience and at the same time results in high quality piercing.

The cam means may comprise a first cam guide for cooperation with an end portion of the bar. During pressing out of the bar from the cavity, the end portion of the bar, and more specifically its rear end portion, will follow and obtain guiding from the first cam guide.

The first cam guide may comprise a portion with an orientation deviating from the aiming line, said portion being adapted to guide the bar during the exiting of the bent bar portion through the opening.

The portion, oriented in a manner deviating from the aiming line, of the first cam guide causes the bent bar to perform a digging motion in substantially the same direction as the bent portion of the bar. As a result, the cross-section of the bar exiting the opening during each incremental step of pressing out remains substantially perpendicular to an aiming line for piercing also when the bent portion of the bar is pressed out of the opening.

The first cam guide may comprise at least one straight portion, which straight portion is adapted to guide the bar while a straight bar portion exits through the opening. This straight portion on the first cam guide is adapted to cooperate with the rear end portion of the bar during the first stage of pressing out the bar when a straight portion in the front end portion of the bar is pressed out of the cavity. As long as the rear end portion of the bar cooperates with the straight portion of the cam guide, the tip of the front end portion of the bar will perform a linear motion. This is important in the cases when the bar has a straight piercing means, for example in the form of a straight cannula.

The first cam guide may define a channel for receiving a member constituting said end portion of the bar. The provision of the channel can, depending on the channel's enclosure of the member, result in a high stability of the bar during pressing out, which is a contributing factor for reduced trauma.

The first cam guide may comprise opposed cup-shaped wall portions which define said channel. The cup-shape is suitably adapted to the intended type of member, that is a hemispherical cup-shape in the case of a spherical member. It will be appreciated that also other shapes than hemispherical are conceivable. The cup-shaped wall portions result in the channel, in cooperation with the member, being capable of forming a ball-and-socket joint which gives the bar guiding and stability during pressing out.

The device may comprise a pressing means to allow pressing out of the bar through the opening, the pressing means being movable in the cavity along a gap which is defined between said cup-shaped wall portions. As a result, the pressing means obtains guiding during pressing out of the bar, which guiding contributes to providing a stable pressing out of the bar. The gap is advantageously designed to allow a linear motion of the pressing means.

The cam means may comprise a second cam guide which is formed by the opening. By the bar being pressed through the opening, the bar obtains guiding by cooperation with wall portions in the opening, which contributes to stability in pressing out. Of course, the efficiency of this guiding depends on the selected tolerance between the size of the opening and the size of the cross-section of the bar perpendicular to the longitudinal axis of the bar.

The cam means may comprise a third cam guide, which third cam guide comprises a straight portion for cooperation with the bar. This cooperation advantageously takes place during an introductory part of pressing out until the end portion of the bar reaches the bent portion of the first cam guide. The third cam guide advantageously cooperates with the bar at least during the piercing stage, that is while the straight portion of the bar is being pressed through the opening and the skin portion involved until an exit hole is created in the skin portion.

The third cam guide may define a groove for receiving the bar. The groove forms with its inner circumferential surface a guide in the longitudinal direction of the groove.

The device may be arranged in two halves, the boundary surface being formed in said halves. The division into halves enables easy and inexpensive manufacture of the device.

The device may comprise an aiming means, which aiming means is adapted to align said opening with at least an entry hole desired for piercing in a skin portion. The aiming means can be arranged to allow alignment even if the point of the desired entry hole is not directly made visible, for instance hidden by the device, before piercing and positioning of a piece of a body jewelry.

The device can be at least partly made of a transparent material. This allows a point for the desired piercing to be made visible through the material of the device.

The opening may be permanently formed in said boundary surface. Such an opening is formed, for example, in connection with the manufacture of the device, for example by injection moulding.

Alternatively, the opening may be adapted to be formed during pressing out of the bar. In this case, the device may comprise, for example, a membrane which constitutes part of the boundary surface, whereby the bar, while being pressed out, penetrates the membrane to form the opening. In this case the membrane forms the second cam guide.

The device may comprise a pinching and sighting means, which pinching and sighting means comprises first and second gripping means which are adapted to grip a skin portion between them, and which pinching and sighting means is adapted to orient the opening arranged in the device relative to at least an entry hole intended for piercing.

DESCRIPTION OF DRAWINGS

The invention will be described in more detail below by way of example and with reference to the accompanying drawings, which illustrate a currently preferred embodiment of the device.

TECHNICAL DESCRIPTION

The inventive device is intended for piercing and positioning a piece of body jewelry with a bent bar in a skin portion. Pieces of body jewelry with bent bars are used preferably in substantially plane skin portions, such as in connection with a navel.

Figure 3:
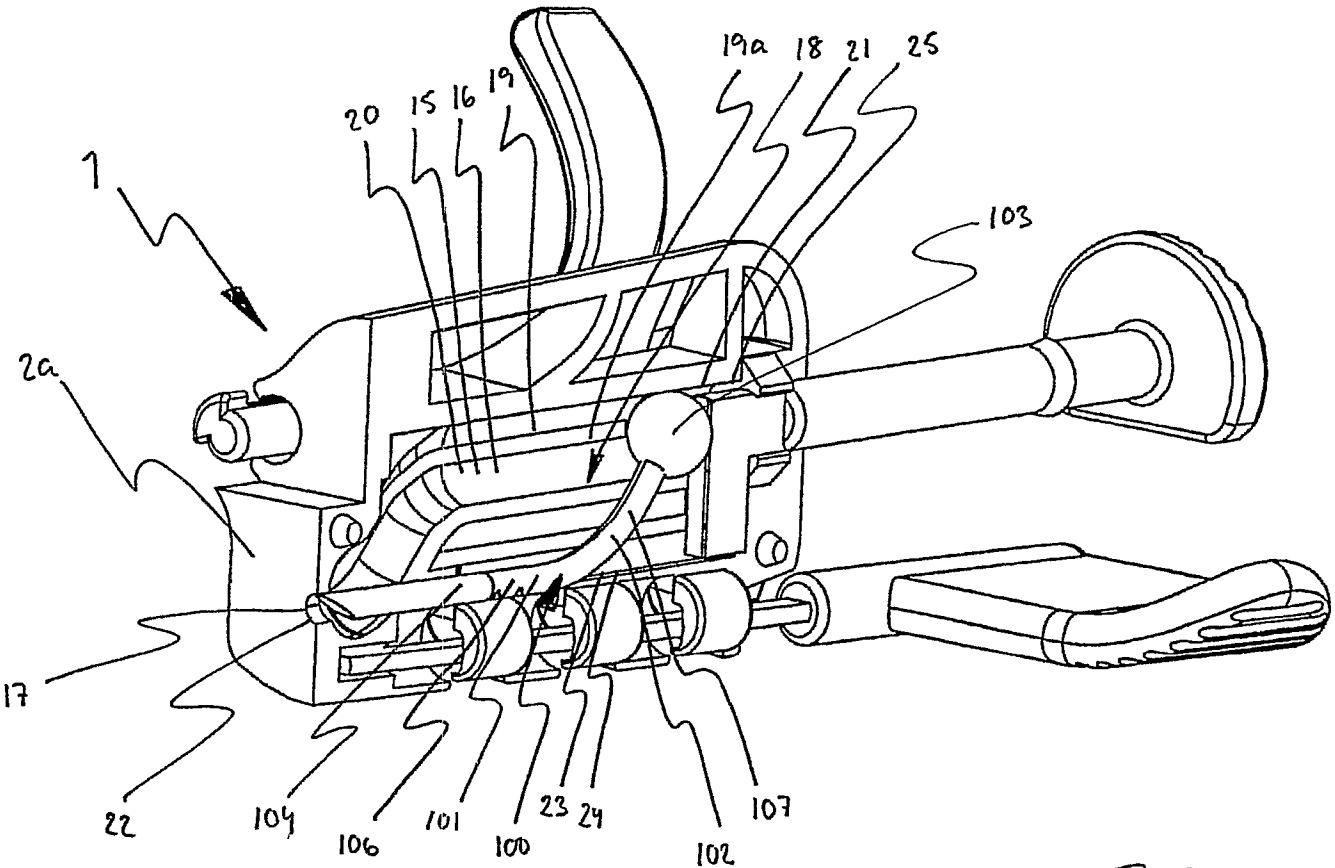
FIG. 3 shows one half of the device with a piece of body jewelry and a pressing means arranged therein.

A frequently used piece of body jewelry 100, see FIG. 3, of this type comprises a single-bent bar 101. The bar 101 has in its rear end portion 102 a member 103 whose primary purpose is to form a stop means to prevent the piece of body jewelry from being pulled out of the skin portion when positioned therein. This member 103, which frequently is a decoration, is usually fixedly arranged on the bar by, for example, soldering or gluing and is often not intended to be detachable. The bar has a straight front end portion for mounting of a detachable locking means (not shown) which is also adapted to prevent the piece of body jewelry from being pulled out of the skin portion when positioned therein. The locking means is mounted after positioning the piece of body jewelry in the skin portion. The locking means can be designed in various ways and its most common variant is a ball which is threaded onto the front end portion of the bar.

If the piece of body jewelry 100 is adapted to be used for piercing, the front end portion 104 comprises a piercing means 105. The piercing means 105 can be integrated with the bar 101 in the form of a sharp tip on its front end portion 104. The tip can be adapted to be removed or not removed after piercing. The piercing means 105 can also be arranged on or arranged loosely in connection with the front end portion 104 of the bar and consist of, for example, a cannula as shown in FIG. 3. The piercing means is usually straight.

The following description of the invention is based on a piece of a body jewelry 100 in the form of a bar 101 which has a piercing means 105 in the form of a straight cannula which is arranged to the front end of the bar 101 to form a front straight end portion 104 of the bar. At the rear end of the bar 101, there is a spherical member 103 to form a rear end portion 102 of the bar. Between them, the bar has a single-bent profile.

Figure 1:
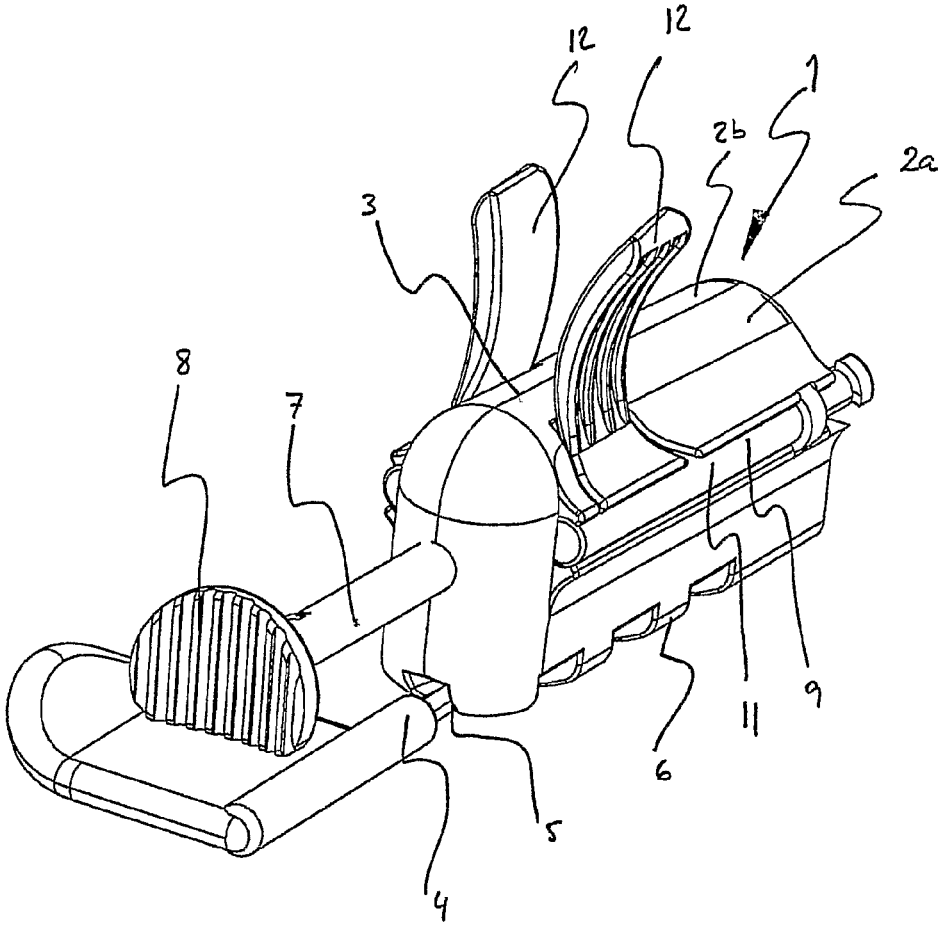
FIGS. 1 and 2 are perspective views seen obliquely from behind and obliquely from the front of a device according to the invention.
Figure 2:
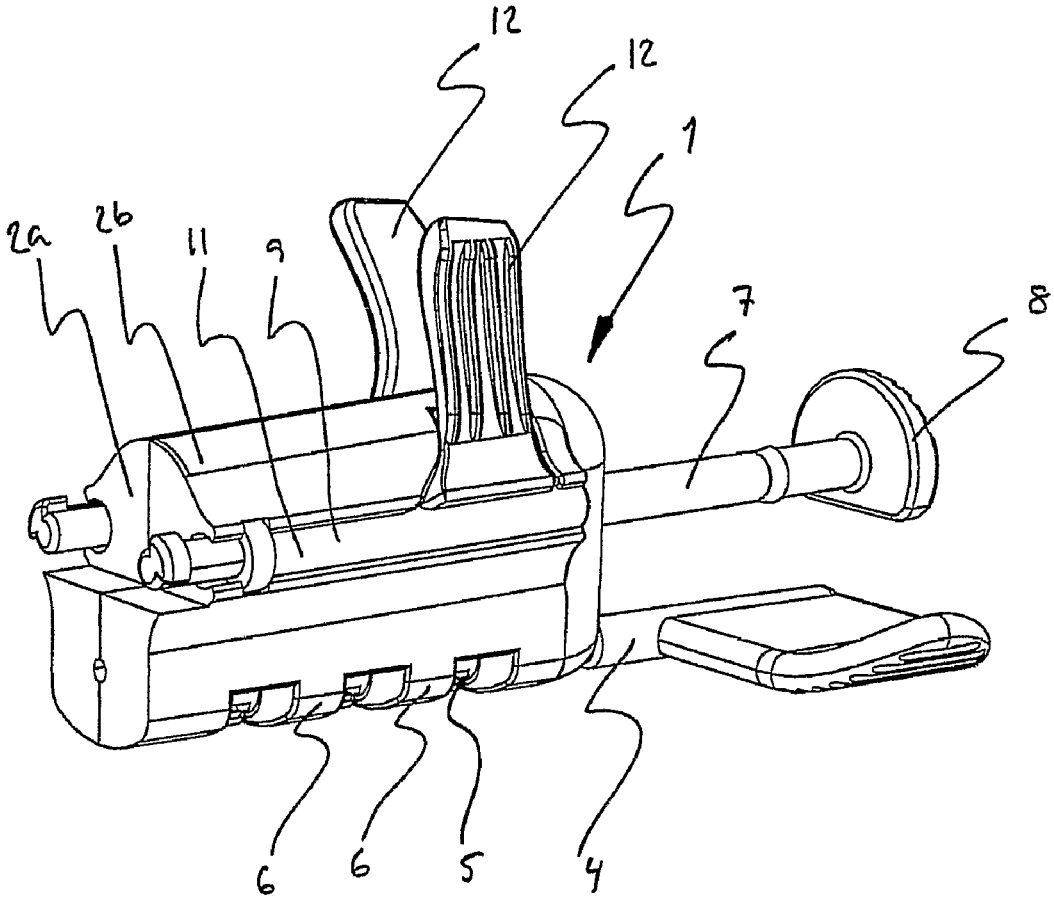

With reference to FIGS. 1 and 2, a preferred embodiment of the inventive device 1 is shown, seen obliquely from behind and obliquely from the front respectively.

The device 1 comprises two halves 2*a*, 2*b* which are articulated to each other by a folding hinge 3 which extends along the upper side of the device. The pivot 3 is in the shown embodiment made of a locally thinner material.

The two halves 2*a*, 2*b* are lockable to each other on the underside of the device 1 to form a closed cavity. In the shown embodiment, this takes place using a pullout cotter pin 4 which is arranged through a channel 5 which is defined by fingers 6 on the underside of the respective halves. The fingers 6 are arranged relative to each other so that they mesh with each other and define a channel 5 when the two halves are joined.

The device 1 comprises a pressing means 7 which is movable inside the device to press out a bar arranged therein. To facilitate operation of the pressing means, its rear end comprises a push-button.

Figure 5:
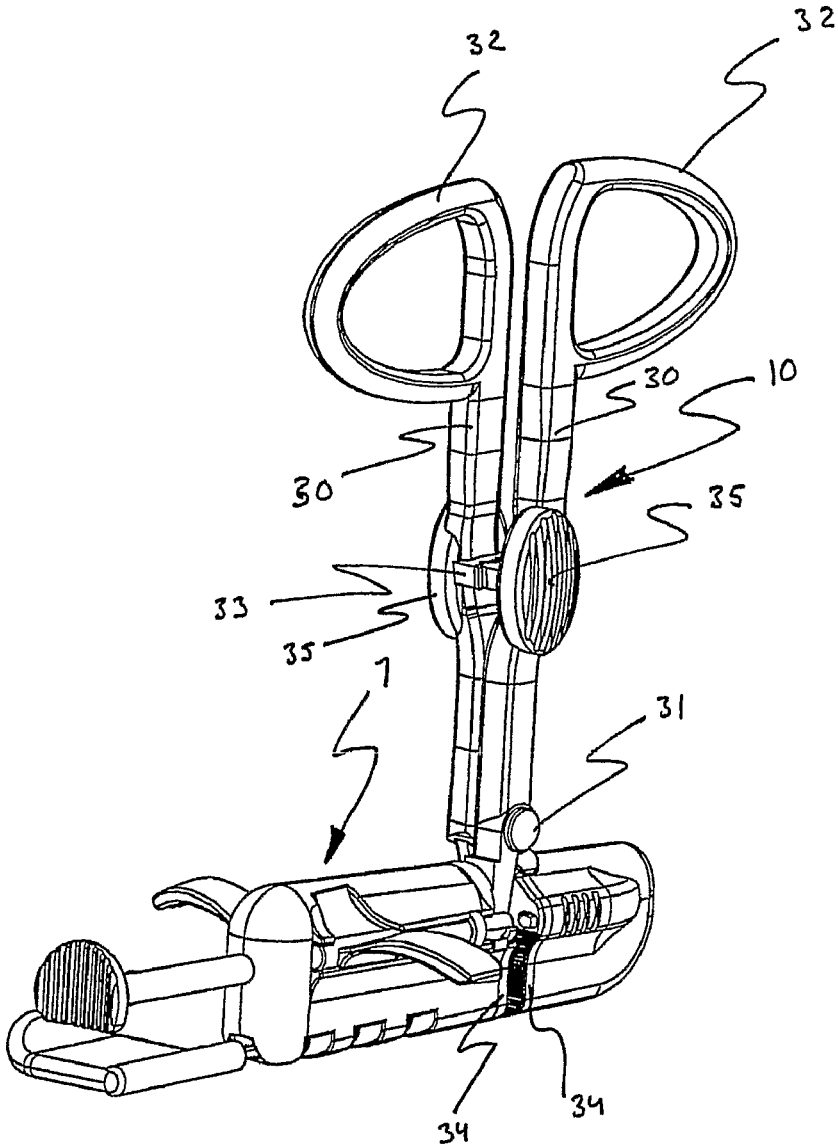
FIG. 5 illustrates the inventive device comprising a pinching and sighting means.

The device further comprises on its outside two locking members 9 which are adapted to cooperate with a pinching and sighting means 10, see FIG. 5. Each locking member 9 comprises a locking pin 11 which is rotatable about its own axis for cooperation and engagement with complementary locking members (not shown) of the pinching and sighting means 10. Each locking member 9 further comprises a gripping surface 12. In a position where the locking pin 11 is rotated into engagement with the pinching and sighting means 10, the gripping surface 12 is lowered to an almost horizontal position, see FIG. 5. In this position, the pressing means 7 can easily be operated by one hand by the forefinger and middle finger being placed around the gripping surfaces 12 while at the same time the thumb applies a pressure to the push-button 8 of the pressing means 7. It will be appreciated that the above described locking member 9 is adapted to cooperate with a pinching and sighting means 10 of the type shown in FIG. 5, and that the locking member 9 can be omitted or be of a different design.

Reference is now made to FIG. 3, which shows the inside of one half 2*a* of the device 1. The half 2*a* comprises an inner boundary surface 15. When bringing two halves 2*a*, 2*b* together, their respective boundary surfaces 15 together define a cavity 16. The thus formed cavity 16 is adapted to accommodate a piece of body jewelry 100 with a bent bar 101 and, optionally, a member 103 arranged on the rear end portion 102 of the bar. For the sake of simplicity, the following description concerns one half.

The boundary surface 15 defines, at the front end of the device, an opening 17 through which the cavity 16 can be made to communicate with the surroundings and through which at least part of the bar 101 can be pushed out. The boundary surface 15 forms a cam means 15 along which the bar 101 is movable while at the same time it is guided by the same.

The cam means 18 comprises a first cam guide 19 which is adapted to cooperate with the rear end portion 102 of the bar 101. The first cam guide 19 comprises a straight portion 19*a* which towards the opening merges into a portion 19*b* deviating from the orientation of the aiming line. In the embodiment illustrated, the first cam guide 19 is arranged in the upper part of the cavity 16.

The first cam guide 19 comprises in each half a cup-shaped wall portion 20. In the shown embodiment, the cup-shape is hemispherical. It will be appreciated that a different geometry can be used. When bringing two halves 2*a*, 2*b* together, these cup-shaped wall portions 20 define between them a channel 21 and, arranged therebetween, a gap 25. The purpose of this channel 21 and gap 25 will be explained below.

The cam means 18 further comprises a second cam guide 22 which is formed by the opening 17 and, more specifically, by the material of the circumferencal surface of the opening. In the embodiment shown, the second cam guide 22 has a length corresponding to the thickness of the surrounding material. The opening 17 is in the shown embodiment circular but may have various cross-sections as long as it provides guiding of the bar during pressing out of the same through the opening.

The cam means 18 further comprises a third cam guide 23 which in the shown embodiment is arranged in the lower portion of the cavity 16. The third cam guide 23 comprises a straight portion in the form of a groove 24 whose opening is facing upwards towards the first cam guide.

Figure 4A:
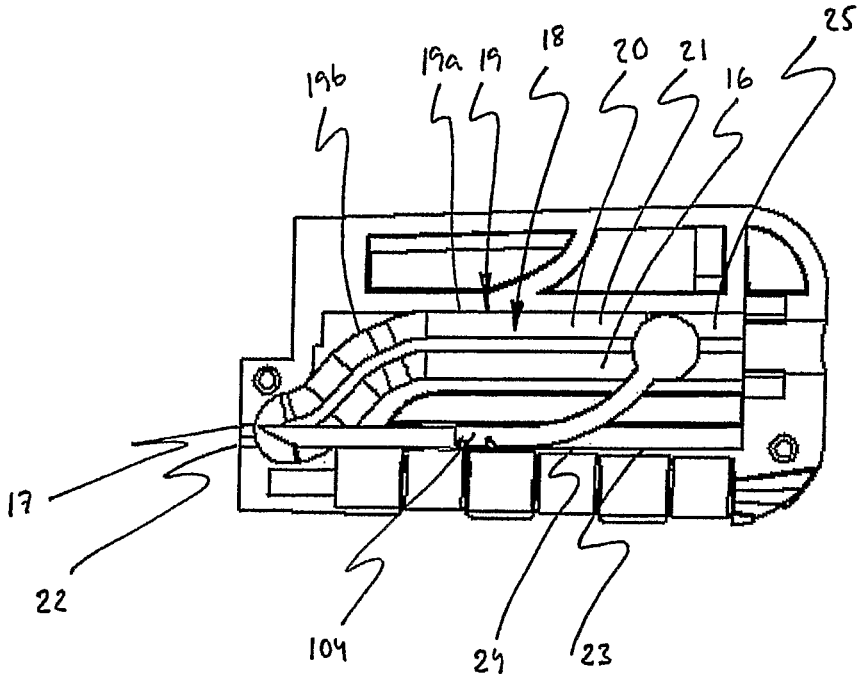
FIGS. 4*a*-4*d* illustrate the position of the piercing means and the bar before, during and after being pressing out of the device.

The bar 101 is arranged in the cavity 16 in such a manner that its front end portion 104 and its straight portion 106 with a piercing means 105 are directed to the opening 17. Furthermore the bar 101 is oriented so that its rear end portion 102 with a member 103 optionally arranged thereon abuts against the straight portion 19*a* of the first cam guide 19. The bent portion 107 of the bar 101 is facing downwards so that the bar is received in the groove 24 and the gap 25. This position constitutes the starting position before pressing out the bar 101 through the opening 17. The pressing means 7 is received at the rear end of the cavity 16 behind the bar 101. The pressing means 7 is arranged to abut against the rear end portion 102 of the bar 101 and obtains guiding from said gap 25. A corresponding position of the bar, however without the pressing means, is shown in FIG. 4*a*.

Figure 4B:
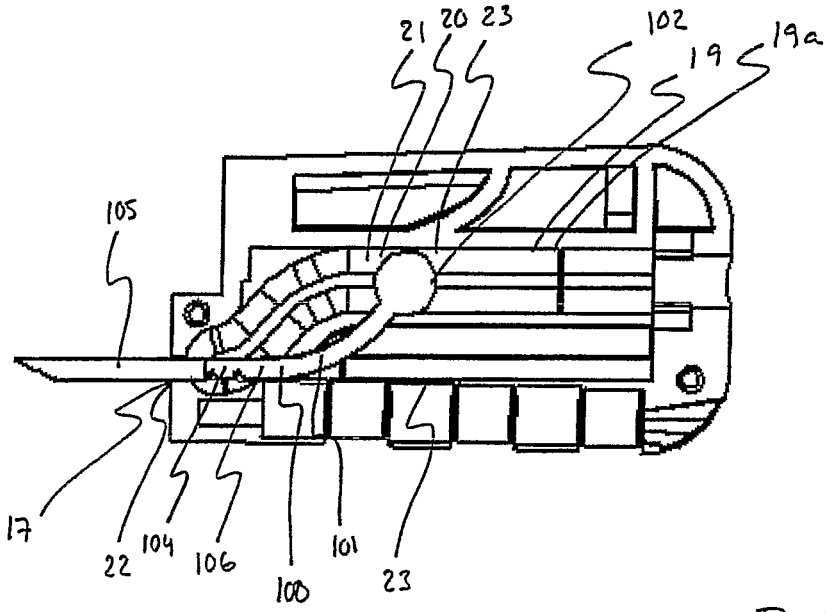

Now referring to FIGS. 4*b* and 5, the bar 101 has been pressed through the cavity 16 so far that the major part of the piercing means 105 by a linear motion has passed out of the opening 17. To arrive at this position, the pressing means 7 shown in FIG. 3 has been pressed forwards through the gap 25 by applying a linear force to the end portion of the bar. During this motion, the rear end portion 102 has obtained linear guiding from the straight portion 19*a* of the first cam guide 19 while at the same time the bar has obtained linear guiding from the straight third cam guide 23, its groove 24 and the gap 25. The bar 101 is prevented by the groove 24 from making a wobbling motion during piercing in the skin portion. Furthermore the bar 101 has obtained guiding from the channel 21 and its cup-shaped wall portions 20.

The length of the straight portion 19*a* of the first cam guide 19 is preferably such that the front end portion 104 of the bar 101, when the rear end portion 102 of the bar has reached the end of the straight portion, has been pressed through the skin portion and formed an exit hole therein. The piercing means has thus created a passage through the skin portion.

Figure 4C:
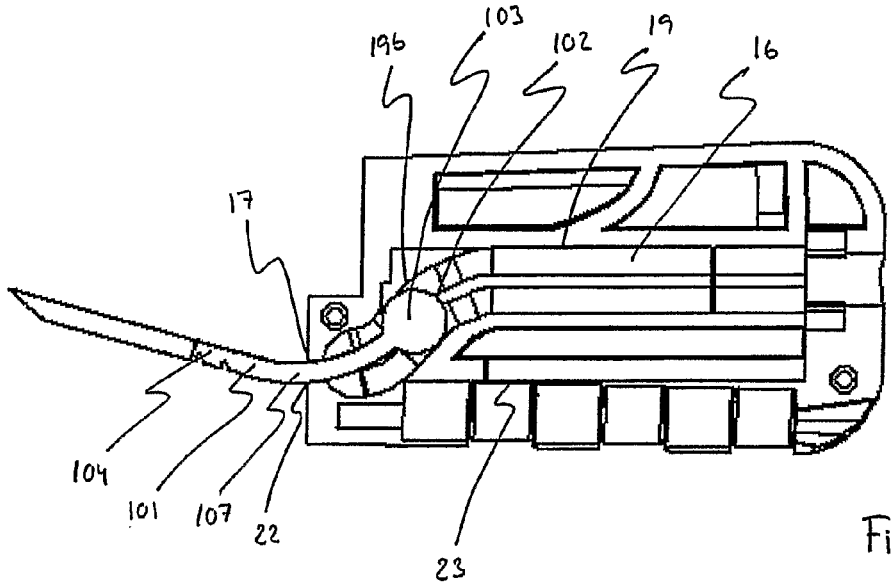

With continued application of force by the pressing means 7, the bar 101 is pressed further through the cavity 16, whereby the rear end portion 102 of the bar 101 and the member 103 arranged thereon reach the portion 19*b* of the first cam guide 19, which portion deviates from the orientation of the aiming line, see FIG. 4*c*. During continued pressing out, the rear end portion 102 of the bar 101 will now follow the portion 19*b* of the first cam guide 19, which portion deviates from the orientation of the aiming line, while at the same time the bent portion 107 of the bar 101 cooperates with the second cam guide 22 to exit through the opening 17. The cooperation of the bar 101 with the third cam guide 23 ceased in connection with the straight portion 106 of the bar 101 leaving the groove 24 and when also the bent part of the bar has left the gap 25.

As a result of the rear end portion 102 of the bar 101 now following the portion 19*b* of the first cam guide 19, which portion deviates from the orientation of the aiming line, the bar performs its digging motion.

In other words, as a result of the cooperation between the rear end portion 102 of the bar 101 and the portion 19*b* of the first cam guide 19, which portion deviates from the orientation of the aiming line, the cross-section of the bar 101 exiting the opening 17 during each incremental step of the pressing out of the bar through the opening will somewhere along a distance between the opening and the exit hole intended for piercing be oriented perpendicular to an aiming line for piercing. By aiming line is meant an imaginary line which extends between a desired entry hole and a desired exit hole in the skin portion in which the piece of body jewelry is to be positioned. By cross-section of the bar is meant a cross-section perpendicular to the longitudinal axis of the bar. This means that the bar, although it is bent, can be passed through an opening which has a cross-section which mainly corresponds to a cross-section of the bar perpendicular to its longitudinal axis. However, it will be appreciated that in practice the opening should be slightly larger to allow tolerance.

Figure 4D:
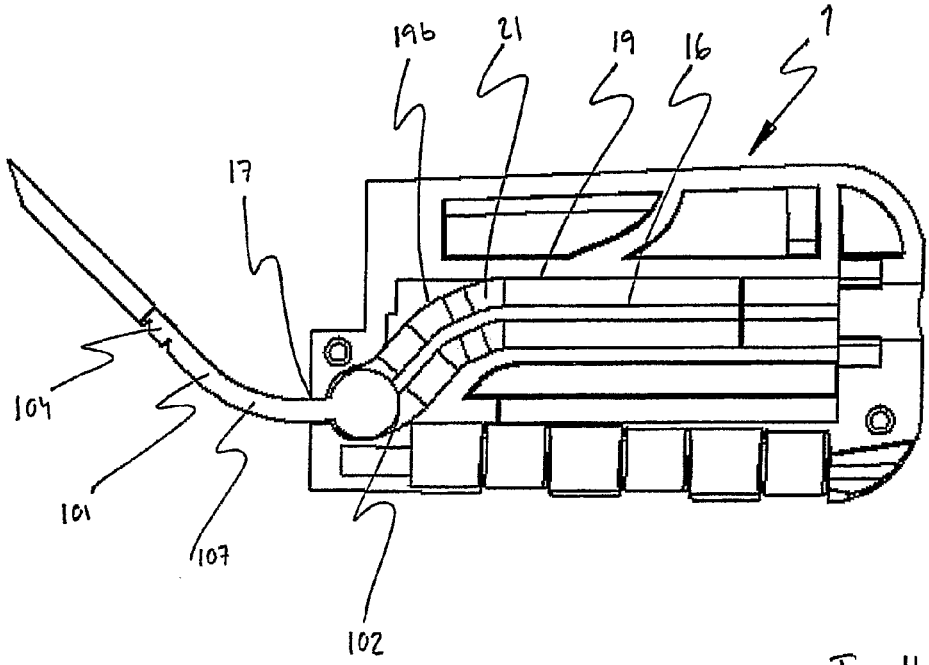

With reference to FIG. 4*d*, the digging motion continues until the rear end portion 102 of the bar 101 reaches the end of the portion 19*b* of the first cam guide 19, which portion deviates from the orientation of the aiming line and suitably terminates adjacent the opening 17. The bar is now positioned in the skin portion in such a manner that the bar has an end portion, which is free in the ambient air and on which a locking means can be fastened.

In the shown embodiment of the device 1, the member 103 on the end portion 102 of the bar 101 is in this position still in the cavity 16 and the cup-shaped channel 21 formed by the first cam guide 19. To release the piece of body jewelry, the previously discussed cotter pin is pulled out, whereby the two halves can be turned apart to uncover the piece of body jewelry.

As mentioned previously, pieces of body jewelry with a bent bar are used in originally plane skin portions. Before piercing, this skin portion is pinched in such a manner that the desired entry hole and exit hole are arranged opposite each other and advantageously uncovered. Pinching takes place using a pinching and sighting means. This can be formed in the device or be a means with which the inventive device cooperates. It will be appreciated that the pinching and sighting means can be designed in various ways and that the construction described below is an example only.

With reference to FIG. 5, the inventive device 1 is shown to comprise a conceivable type of a pinching and sighting means 10. The pinching and sighting means 10 comprises, in the shown embodiment, first and second legs 30 which are articulated to each other by a hinge 31. The upper parts of the legs comprise gripping surfaces 32 in the form of loops by means of which the operator can grip and operate the pinching and sighting means. Between these gripping surfaces and said hinge there are two complementary locking portions 33 which allow mutual locking of the two legs 30.

The lower parts of the legs, that is below said hinge, comprise gripping means 34 between which the skin portion involved is adapted to be pinched.

In the embodiment illustrated, the gripping means 34 are arranged as opposite, grooved plates, each having a through hole (not shown) to uncover and, thus, allow access from both sides of a skin portion which is squeezed between them. The through holes constitute a possible form of aiming means.

The first gripping means comprises locking members (not shown) which are adapted to cooperate with the above described locking members of the device.

The illustrated pinching and sighting means 10 further comprises two additional gripping surfaces 35 which are positioned so as to prevent the operator from unintentionally releasing the locking action obtained by means of the locking portions if/when he holds the pinching and sighting means during the piercing operation for instance.

The shown pinching and sighting means 10 is advantageously formed in two parts which are joined to each other by said hinge 31. Each part is preferably made by injection moulding of a polymer material. The material can be transparent at least in the gripping surfaces. The pinching and sighting means is advantageously intended to be disposable. Alternatively, at least the parts thereof which are close to or come into contact with the skin portion which is being pierced can be intended to be disposable. It will be appreciated that the pinching and sighting means can be designed in various ways with the function maintained and that the above illustrated and described embodiment constitutes but a possible design. It will further be appreciated that a pinching and sighting means can be part of a device and be operated with the same. It may also be included in an instrument, for instance a multiple-use instrument, with which the device is operated.

The device 1 and alternatively the pinching and sighting means 10 may comprise a cannula catcher (not shown) or alternatively a locking means holder which suitably is arranged or is to be arranged opposite to the opening through which the bar is pressed out during the piercing operation. If the bar comprises a detachable piercing means, this can be pressed directly into and caught by a cannula catcher for destruction. If the bar comprises a piercing means in the form of, for example, a sharp tip, this can immediately after piercing be pressed into a locking means which is arranged in a locking means holder.

The device is preferably made by injection moulding of a polymer material. The polymer material can be transparent in at least part of said device. The transparent part is preferably arranged adjacent to the front portion of the device adjacent to the opening to allow at least a desired entry hole in a skin portion to be visible.

The above-mention pressing means 7 may be part of the device and operated with the same. It may also be included in an instrument, for example a multiple-use instrument, with which the device and its pinching and sighting means is operated, or with which the device is arranged for a pinching and sighting means.

The device may comprise an aiming means (not shown) with which the opening and the bar can be oriented relative to the desired position of at least the entry hole for piercing. The aiming means can be designed in various ways and need not require that the specific point of the desired entry hole be visible. The aiming means may consist of, for example, an aiming cross in or on the device.

It will be appreciated that the shown configuration of the cam means 19 and its cam guides is only one possible configuration and that the principle is applicable to other bar geometries than a single-bent bar.

It will further be appreciated that the opening 17 can be formed in a number of ways instead of, as illustrated, be formed in the boundary surface 15 in each half 2*a*, 2*b*. The device may, for example at its front end, have a membrane which constitutes part of the boundary surface and through which the bar is pressed during pressing out to form an opening and, thus, the second cam guide.

The device can advantageously be made to be disposable.

A device for piercing and positioning of pieces of body jewelry with a bent bar has been described above. It will be appreciated that the present invention is not limited to the shown embodiments and that several modifications and variants are conceivable. The invention is thus defined exclusively by the appended claims.

The invention claimed is:

1. A device (1) for piercing and positioning a piece of body jewelry (100) with a bent bar (101) in a skin portion, the device (1) comprises:

an inner boundary surface (15) which defines a cavity (16) for holding a bent bar (101), the bar being movable out of the cavity to the surroundings through an opening (17) defined by the boundary surface, and a cam (18) which is in the boundary surface (15) and along which said bar (101) is movable for such guiding of the bar that, during each incremental step of pressing out, the bar has a cross-section exiting the opening (17), which is perpendicular to a longitudinal axis of the bar, the cam (18) comprises a first cam guide (19) for cooperation with an end portion (102) of the bar (101), and the first cam guide (19) comprises a portion (19*b*) with a curving orientation deviating from an orientation of another portion of the first cam guide as the cam extends along the device and thereby deviates the guiding of the end portion of the bar in a curving motion as it passes through the device, the first cam guide (19) defines a channel (21) for receiving a member (103) constituting said end portion of the bar (101), the first cam guide (19) has opposed cup-shaped wall portions (20) which define said channel (21); and a pressing device (7) to allow pressing out of said bar (101) through said opening (17), the pressing device being movable in the cavity (16) along a gap (25) which is defined between said cup-shaped wall portions (20).

2. A device as claimed in claim 1, in which the other portion of the first cam guide (19) comprises at least one portion (19*a*) which is straight in orientation and which is adapted to guide the bar (101) during the exiting of a straight bar portion (106) through the opening (17).

3. A device as claimed in claim 1, in which the cam (18) comprises a second cam guide (22) which is formed by the opening (17).

4. A device as claimed in claim 2, in which the cam (18) comprises a third cam guide (23), which third cam guide comprises a straight portion for cooperation with the bar.

5. A device as claimed in claim 4, in which the third cam guide (23) defines a groove (24) for receiving the bar.

6. A device as claimed in claim 1, which is arranged in two halves (2*a*, 2*b*), the boundary surface (15) being formed in said halves.

7. A device as claimed in claim 1, which is at least partly made of a transparent material.

8. A device as claimed in claim 1, in which the opening (17) is permanently formed in said boundary surface (15).

9. A device as claimed in claim 1, in which the opening (17) is configured for the pressing out of the bar (101).

10. A device as claimed in claim 1, comprising a pinching and sighting device (10), which pinching and sighting device comprises first and second gripping devices (34) which are adapted to grip a skin portion between them, and which pinching and sighting device is adapted to orient the opening arranged in the device relative to at least an entry hole intended for piercing.

* * * * *